US009688441B2

(12) United States Patent
Koesters

(10) Patent No.: US 9,688,441 B2
(45) Date of Patent: Jun. 27, 2017

(54) SIDE-GUSSET BAG AND METHOD OF MAKING SAME

(71) Applicant: MONDI Consumer Packaging Technologies GmbH, Gronau (DE)

(72) Inventor: Jens Koesters, Wallenhorst (DE)

(73) Assignee: MONDI CONSUMER PACKAGING TECHNOLOGIES GMBH, Gronau (DE)

( * ) Notice: Subject to any disclaimer, the term of this patent is extended or adjusted under 35 U.S.C. 154(b) by 0 days.

(21) Appl. No.: 14/847,386

(22) Filed: Sep. 8, 2015

(65) Prior Publication Data

US 2016/0075481 A1 Mar. 17, 2016

(30) Foreign Application Priority Data

Sep. 16, 2014 (EP) ..... 14184973

(51) Int. Cl.

| | |
|---|---|
| ***B65D 33/06*** | (2006.01) |
| ***B65D 30/20*** | (2006.01) |
| ***B31B 1/86*** | (2006.01) |
| ***B31B 45/00*** | (2006.01) |
| ***B65D 33/10*** | (2006.01) |

(52) U.S. Cl.

CPC ..... *B65D 33/06* (2013.01); *B31B 1/86* (2013.01); *B31B 45/00* (2013.01); *B65D 31/10* (2013.01); *B65D 33/10* (2013.01); *B31B 2219/9077* (2013.01); *B31B 2221/50* (2013.01); *B31B 2221/60* (2013.01)

(58) Field of Classification Search

CPC .... B31B 2219/9077; B31B 2219/9093; B31B 2219/9096; B31B 1/86; B31B 45/00; B31B 2221/50; B31B 2221/60; B65D 31/10; B65D 33/10; B65D 33/06

USPC ..... 383/6; 493/226, 244

See application file for complete search history.

(56) References Cited

U.S. PATENT DOCUMENTS 3,208,492 A * 9/1965 Braithwaite ..... B65D 33/065 383/20

7,331,917 B2 2/2008 Totani (Continued)

FOREIGN PATENT DOCUMENTS

| | | |
|---|---|---|
| EP | 1754196 A | 2/2007 |
| EP | 2039620 A | 3/2009 |
| WO | 2009095806 A | 8/2009 |

*Primary Examiner* — Peter Helvey

(74) *Attorney, Agent, or Firm* — Andrew Wilford

(57) ABSTRACT

A side-gusset bag has front and back face panels each having two longitudinally extending side edges. Two folded side panels are each joined to the face panels at the side edges and each having a center longitudinally extending crease between the respective side edges. A handle assembly consists of a pair of substantially identical handle halves each formed by two longitudinally spaced ends fixed to one of the side folds to a respective side of the crease thereof and a middle section extending between the respective ends and formed unitarily therewith of plastic film. The middle sections are transversely spaced and form an open longitudinally extending gap at least 2 mm wide and aligned with the respective crease. The middle sections extend transversely over less than 80% of a transverse width of the one side fold and have outer edges space at least 5 mm from the respective side edges.

14 Claims, 3 Drawing Sheets

(56) References Cited

U.S. PATENT DOCUMENTS

| | | | | |
|---|---|---|---|---|
| 8,142,340 | B2 * | 3/2012 | Mantzivis | B31B 19/86 383/10 |
| 8,322,923 | B2 * | 12/2012 | Gum | B65D 33/10 383/120 |
| 8,597,168 | B2 | 12/2013 | Koesters | |
| 2008/0080794 | A1 * | 4/2008 | Kruse | B31B 19/86 383/14 |
| 2009/0202181 | A1 * | 8/2009 | Alaux | B31B 19/36 383/7 |
| 2011/0033133 | A1 | 2/2011 | Kujat | |
| 2011/0305407 | A1 * | 12/2011 | Gum | B65D 33/10 383/11 |

* cited by examiner

SIDE-GUSSET BAG AND METHOD OF MAKING SAME

FIELD OF THE INVENTION

The present invention relates to a bag made of plastic film. More particularly this invention concerns such a bag with a handle and a method of making same.

BACKGROUND OF THE INVENTION

A prefabricated and unfilled side-gusset bag typically has front and back two face panels and two folded side panels that are each joined to the face panels at side edges and that each have a crease running in a bag longitudinal direction in the center between the respective side edges. A handle assembly has a film handle attached to one of the folded side panels on an outer side of the bag. This handle assembly further has longitudinally spaced handle ends and a handle middle section between the handle ends that extends transversely, i.e. perpendicular to the longitudinal direction, over less than 80% of the width of the respective folded side panel and has a spacing of at least 5 mm from each of the two respective side edges.

Side-gusset bags are used in various sizes for packaging purposes and are suitable, for example, as packaging for bulk goods such as dry feed for animals, detergent, cat litter, salt and powdery or grainy construction materials.

Such side-gusset bags are often also provided with a reclosable fastener in order to enable a certain level of protection after initial opening and removal of a partial quantity.

Such a reclosable fastener is usually arranged on a bag top or at least one upper region of the bag and can extend only over a part, for example a folded side panel, or the entire width. The reclosable fastener can be embodied, for example, as a so-called zipper or slide closure having rail-shaped groove and spring elements that can be closed manually by pressure in the case of a zipper closure or, in a slide closure, by a slide in the manner of a zipper, and opened through application of force in the opposite direction. Other reclosable fasteners, such as hook-and-loop fasteners or self-adhesive strips, for example, are also worthy of consideration.

Various manufacturing methods are known for the manufacture of side-gusset bags. For instance, the entire side-gusset bag can be formed by folding from a single film web. Both individual prefabricated side-gusset bags and side-gusset bags that are not yet sealed on at least one edge can be formed that are first stored and transported and then filled and sealed only later. One advantage of such pre-made bags is that relatively low equipment costs are involved. The prefabricated side-gusset bags are opened and then filled via a filling funnel before they are sealed by welding, adhesion and/or folding-over of the open section. The sealed side-gusset bag generally ensures tight storage of the filled product.

It is also possible to form individual bags using a so-called FFS (form fill and seal) method from a continuous film immediately during filling. To do this, a film tube with folded side panels is formed directly around a filling funnel that is then sealed immediately after filling, individual bags also being separated from the strip.

However, the present invention also relates to embodiments in which the face panels and the folded side panels are formed from separate pieces of a bag film.

U.S. Pat. No. 7,331,917 describes a method of making side-gusset bags in which a strip of bags is formed such that successive side-gusset bags are arranged with their bag longitudinal edges next to each other. The direction of production thus corresponds to a bag transverse direction of the individual side-gusset bags. According to U.S. Pat. No. 7,331,917, a strip of bags is first formed with successive, initially connected bag blanks. A first film web is guided in the direction of production. A film strip is then fed in, the edges of the film strip being folded over onto a middle section. The edges are usually of equal width, and a gap still remains between the two edges after folding.

Pieces of the film strip are then placed onto the first film web at a uniform spacing transverse to the direction of production (i.e., along the bag longitudinal direction) before a second film web is fed in the direction of production with which the first film web and the pieces of the film strips are covered. Longitudinal welds are then produced transverse to the direction of production with which the film strips are welded at the folded-over edges to the second film web on the one hand and welded at their opposite edge to the first film web on the other hand. Finally, individual side-gusset bags are separated from the strip of bags formed in this way by a cut in the region of the film strips such that two folded side panels of successive side-gusset bags are formed from one folded film strip. The described method is also referred to in practice as a transverse method or Totani method.

Independently of the method of making the side-gusset bag, a need often exists to provide the side-gusset bag with a handle assembly, such a handle assembly being on a bag top or on one of the two folded side panels.

The present invention relates specifically to a side-gusset bag with a handle assembly that is attached on the outside of the bag to one of the two folded side panels, the handle assembly having a film handle and being connected to handle ends when seen longitudinally, a handle section being located between the handle ends. The user's hand can then be passed between the handle section and the underlying folded side panel.

The entire handle assembly extends transversely, i.e., perpendicular to the longitudinal direction, over less than 80%, preferably less than 60% of the width of the respective folded side panel between the side edges, the handle assembly also having a spacing of at least 5 mm, preferably at least 15 mm from each of the two respective side edges.

Generic side-gusset bags are known in practice in which a single straight film strip with self-adhesive handle ends is applied to one of the folded side panels. To ensure a uniform weight distribution, such a film strip is arranged as a handle assembly transversely in the center, i.e., along the crease of the side edge. However, this leads to the corresponding folded side panel being spread open to a certain extent by the handle assembly when laid flat. This spreading effect renders storage and handling of prefabricated, unfilled side-gusset bags difficult. It must also be considered here that a relatively thick film is usually used for the handle assembly that is able to carry the entire side-gusset bag.

Against this background, difficulties also arise with FFS side-gusset bags with a glued-on film strip as a handle.

A generic side-gusset bag is known from WO 2009/095806 in which a weakening line can be provided in the film handle in order to enable easier folding of the side edge in the region of the handle assembly. Particularly with a thick film handle, however, a substantial tendency to spreading still remains.

Moreover, handle assemblies of other types are also known from the prior art. For instance, EP 2 039 620 describes a handle assembly with a film strip running transversely that is attached at the side edges.

U.S. Pat. No. 8,597,168 discloses a handle assembly with two loop handles that are each arranged at a side edge. Even though handling is rendered especially comfortable by the described design with two loop handles, manufacturing is relatively expensive.

A side-gusset bag with a handle on a folded side panel is known from U.S. 2011/0033133. Besides simple glued-on handle assemblies, other handle assemblies are described that have at least one film slip on the inside of the bag. Here, too, one encounters the limitation of relatively expensive manufacturing, and a substantial spreading effect is also observed depending on the design.

OBJECT OF THE INVENTION

Against this background, it is the object of the present invention to provide a side-gusset bag with a handle assembly secured to a folded side panel from the outside that has a lesser tendency to spread the corresponding folded side panel.

Another object is to provide an improved method of making such a side-gusset bag.

SUMMARY OF THE INVENTION

A side-gusset bag has according to the invention front and back face panels each having two parallel and longitudinally extending side edges. Two folded side panels are each joined to the face panels at the side edges and each having a center longitudinally extending crease between the respective side edges. A handle assembly consists of a pair of substantially identical handle halves each formed by two longitudinally spaced ends fixed to one of the side folds to a respective side of the crease thereof and a middle section extending between the respective ends and formed unitarily therewith of plastic film. The middle sections are transversely spaced and form an open longitudinally extending gap at least 2 mm wide and aligned with the respective crease. The middle sections extend transversely over less than 80% of a transverse width of the one side fold and have outer edges space at least 5 mm from the respective side edges.

According to the invention, the region of the crease is thus left clear, so that the film handle itself need not even be folded over. The spreading effect is reduced substantially by this alone. Moreover, the width of the gap is at least 2 mm so that air also remains directly at the crease, thus enabling the corresponding folded side panel to easily be folded over onto itself.

As described below, the gap also makes it possible for the crease to be formed by a fold knife or the like during manufacture of the side-gusset bag only if the two film handle sections have already been applied. Hence it is precisely along the crease that a region that is free from the film handle remains that can be easily manipulated and folded over.

The gap is advantageously straight over its entire length and also has is of uniform width.

The gap is selected such that the spreading effect at the respective side edge is minimized, while the two film handle halves can easily be gripped by a user as a common handle. According to the invention, the gap has a width of at least 2 mm, preferably at least 5 mm. On the other hand, the gap is advantageously smaller than 20 mm, preferably smaller than 15 mm. One suitable gap dimension is 10 mm, for example.

The side-gusset bag is preferably formed as a prefabricated, flattened package that is sealed at one longitudinal end and unsealed at the opposite longitudinal end for subsequent filling. Particularly with such a prefabricated side-gusset bag (pre-made bag), good storability and easy handling in the as-of-yet unfilled state is important.

Usually, the first film handle section and the second film handle section are mirror symmetrical to each other with at the crease.

In order enable particularly good fastening of the handle assembly to the respective folded side panel on the one hand and easy handling on the other hand, according to one preferred embodiment of the invention the handle assembly is widened transversely at the handle ends with respect to the middle handle section, the two film handle sections then having a C-shape projecting from the gap in the direction of the respective side edge. Apart from the center gap between the two film handle sections, this results in a shape shaped generally like a dog bone.

A provision can be made within the scope of the invention that the two film handle halves are interconnected exclusively via the underlying respective folded side panel.

According to an alternative embodiment of the invention, the two film handle sections are connected by an application film, the application film being thin in comparison to the film handle, however. Accordingly, the ratio of the thickness of the film handle to the thickness of the application film is at least 3:1. If the two film handle sections are connected by a thin application film, this results in the advantage that the two film handle sections can be fed and attached more easily during manufacture.

While the film handle usually has a thickness between 150 μm and 400 μm, particularly between 200 μm and 300 μm, the application film can readily be embodied with a thickness of less than 100 μm, particularly less than 50 μm. The application film essentially provides for good handling of the film handle sections during manufacturing and does not have to absorb any weight or tensile forces. In addition, however, it results in the advantage that the handle assembly has an apparently one-piece form that is familiar to the user, so a user will always grab both film handle halves as one handle loop.

As already explained at the outset, the side-gusset bag can be formed from a material web or a film blank by folding. Alternatively, particularly with the transverse method described at the outset, pieces of a bag film are supplied separately to form the two face panels and the two folded side panels and then joined into a bag body.

Independently of the two alternative embodiments, a multilayer bag film is generally provided that can be welded on the inner side and has a high-quality outer layer.

In practice, film laminates with an interior imprint are often used, and such a laminated composite often has an outer film made of polyethylene terephthalate (PET) or biaxially oriented polypropylene (BO-PP), the inner surface of the bag film formed by an inner film being made of polyethylene (PE).

Since the plastic film on the outside of the bag often cannot be welded or only with difficulty, the handle assembly is preferably adhered to the handle ends. Handle assemblies that are self-adhesive and consequently need only be placed onto the corresponding folded side panels and optionally also pressed are particularly suitable. In principle, however, insofar as the side-gusset bag can also be welded on the outside of the corresponding folded side panel, attachment can also be achieved by welding.

Within the scope of the invention, the face panels and/or the folded side panels of the side-gusset bag can have a layer of a plastic woven fabric. Particularly in such a bag type, the bag body is relatively strong and difficult to work, so spreading in the region of the handle arrangement can then have a very disadvantageous effect.

Within the scope of the invention, the folded side panels can extend longitudinally over the same height as the two face panels or be lower than the face panels. Folded side panels are lower than a bag top result particularly in a transverse method. In contrast, if the folded side panels are formed solely by folding from a strip of bags, folded side panels can be shortened by punches. Commensurate measures are known, for example, from EP 1 754 596.

Preferably, the side edges are also provided with a longitudinal weld. While such longitudinal welds are necessary in a side-gusset bag manufactured using a transverse method in order to weld the formed bag body in the circumferential direction, corresponding longitudinal welds are advantageous for stiffening in a side-gusset bag formed by folding a material web or a film blank.

According to the invention, the entire handle assembly extends over less than 60% of the width of the respective folded side panel, with a spacing of at least 15 mm also remaining with respect to the respective adjacent side edges. Accordingly, the side edges and, optionally, longitudinal welds as well can easily be formed during the manufacturing process without the handle assembly constituting an impairment, even if it is already applied during the folding of the film and/or during the production of longitudinal welds.

The invention also relates to a method of making a side-gusset bag having two face panels and two folded side panels from one bag film, particularly the previously described side-gusset bag. During the manufacturing process, a handle assembly having a film handle is placed onto a bag film section forming a first folded side panel such that a gap with a width of at least 2 mm running between two film handle sections of the film handle runs along a center line of the corresponding first folded side panel. A crease is formed along the center line of the first folded side panel and a center line of the second folded side panel and, in addition, a bag body is formed by folding the bag film and/or by joining several pieces of the bag film such that the two folded side panels are folded onto themselves at the respective crease and placed between the face panels. Preferably, the cited steps are performed in the described sequence. Even though a different procedure is possible in principle and the first folded side panel can of course also be unfolded subsequently for the mounting of the handle assembly, the handle assembly is preferably applied to the still-flat, unfolded bag film section before it is folded into the shape of the folded side panel. Particularly here, it is then especially advantageous that the relatively thick and stiff film handle cannot also be turned over.

Within the scope of the invention, there are various possibilities for mounting the film handle sections. For instance, the two film handle sections can be supplied separately from each other and attached to the respective bag film section.

According to an alternative embodiment of the invention, a provision is made that the two film handle sections are supplied together with an application film, the application film being pulled off of the film handle sections after the attachment of the film handle sections to the respective bag film section. The film handle sections can then be supplied on the application film as a kind of substrate and separated from this substrate in the manner of labels.

In such an embodiment, the application film is usually a continuous strip.

According to another variant, provision is made that the two film handle sections are supplied together with an application film, the application film remaining on the film handle sections. In such an embodiment, if the application film is provided as a continuous strip, a perforation or weakening line is advantageously provided in the shape of the handle assembly so that the individual handle assemblies with the two film handle sections and the similarly shaped application film can then be separated. Alternatively, the two film handle sections can also be connected by an application film having the shape of a conventional handle. Handling is then similar to that of a conventional handle assembly with a continuous film handle, although a slight fold is possible according to the invention at the gap of the film handle. The application film is then selected so as to be so thin that it does not impair folding and also does not produce any substantial spreading effect.

BRIEF DESCRIPTION OF THE DRAWING

The above and other objects, features, and advantages will become more readily apparent from the following description, reference being made to the accompanying drawing in which.

SPECIFIC DESCRIPTION OF THE INVENTION

Figure 1:
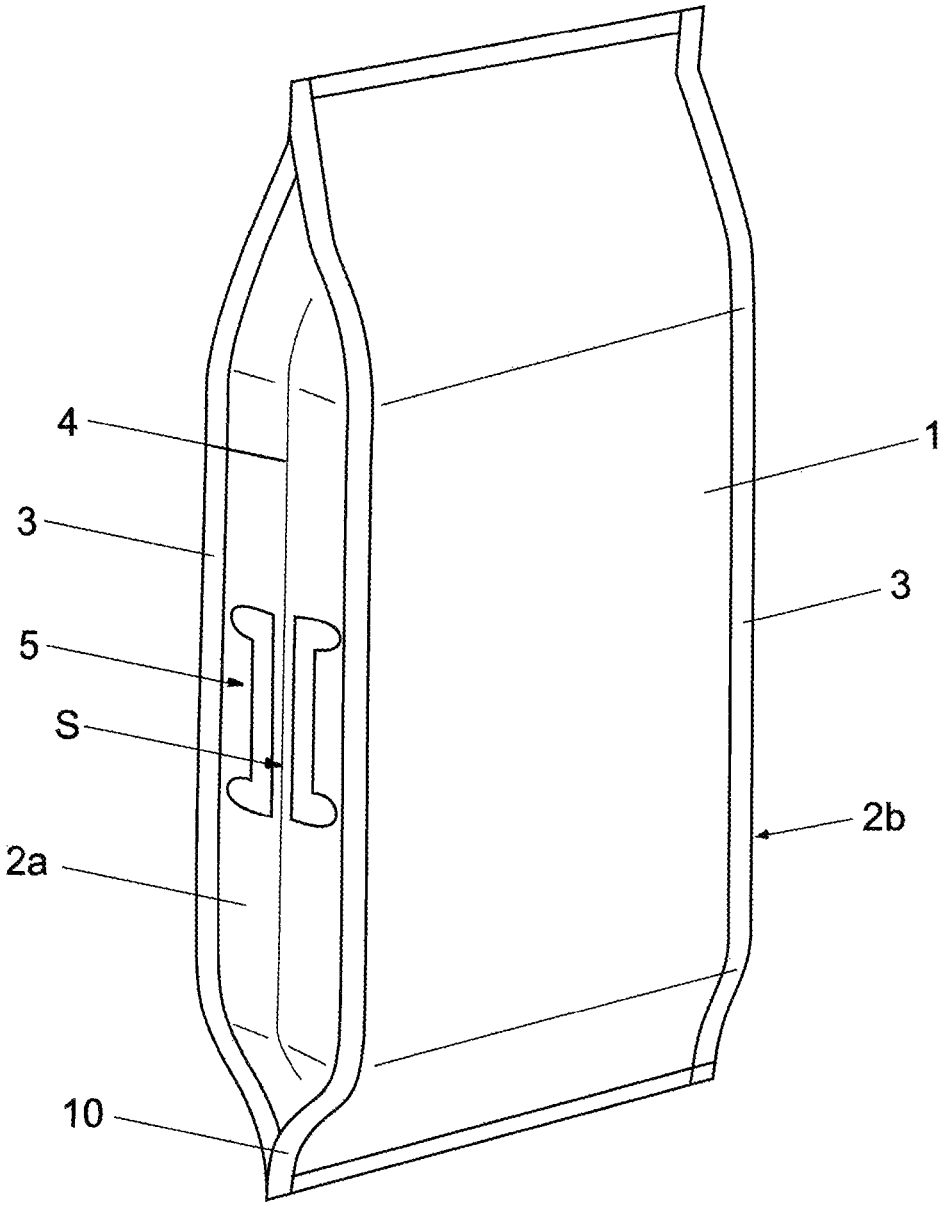
FIG. 1 is a perspective view of a side-gusset bag with a handle assembly on one of the folded side panels.

As seen in FIG. 1 a filled and tightly sealed side-gusset bag is preferably produced first as a prefabricated unfilled side-gusset bag and then subsequently filled and sealed. The side-gusset bag comprises two opposite face panels 1 and two folded side panels 2*a*, 2*b* that are each joined to the face panels 1 at side edges 3 and connect the face panels 1 to each other.

In the center between the respective side edges 3, the folded side panels 2*a*, 2*b* each have a straight crease 4 running in a bag longitudinal direction 1, a handle assembly 5 having a film handle being attached to one of the folded side panels 2*a* on an outer side of the bag. According to the invention, provision is made that the handle assembly 5 is interrupted at the crease 4 by a gap S with a width $b_{Sp}$ of at least 2 mm and running in the longitudinal direction 1 that separates the film handle into a pair of handle halves.

Figure 2:
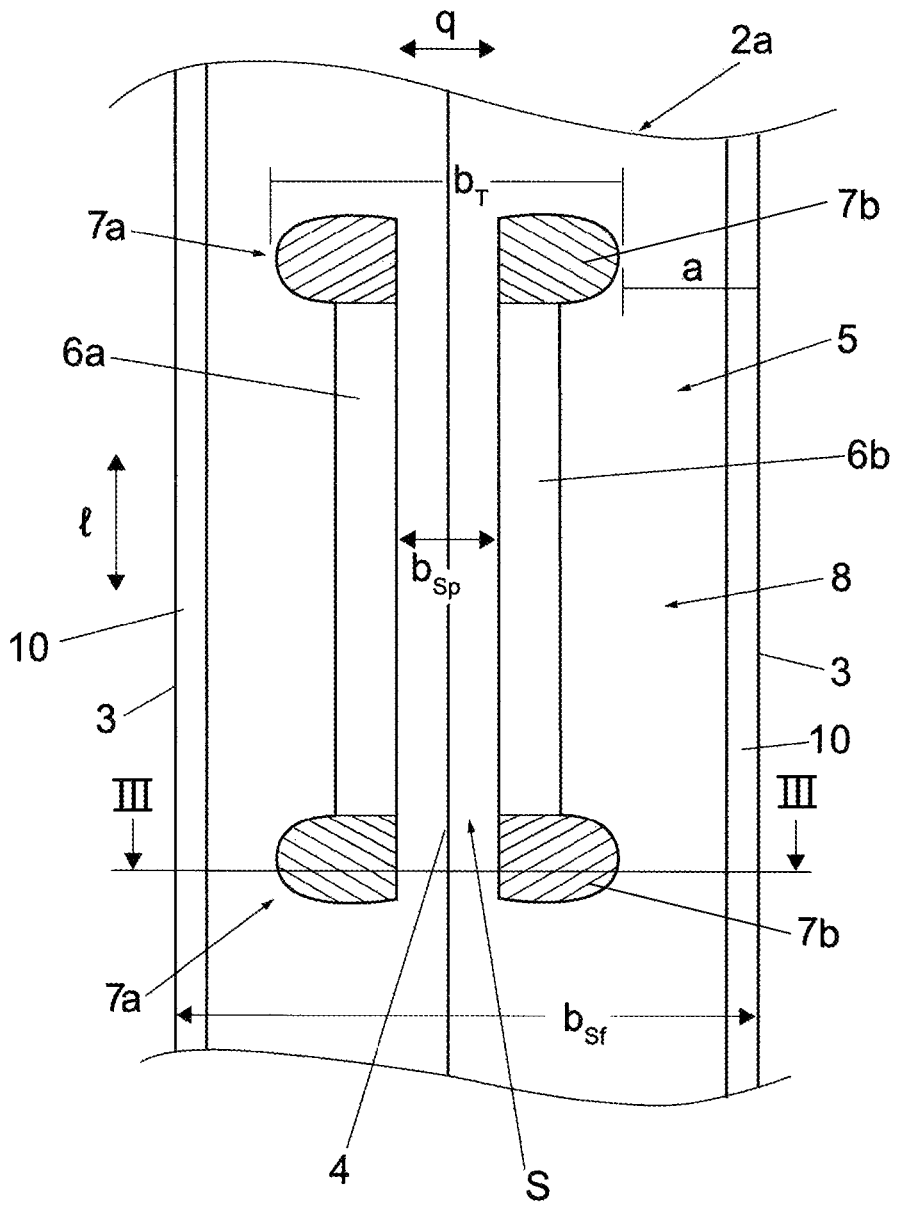
FIG. 2 is a side view of a detail of the handle assembly on the one folded side panel.

FIG. 2 shows a detailed view of the handle assembly 5 on the folded side panel 2*a*. It can be seen here that the handle assembly has a width $b_T$ in a transverse direction q that is less than 60% of the width $b_{Sf}$ of the folded side panel 2*a*, the spacing a between the handle assembly 5 and the adjacent side edges 3 each also being at least 15 mm. The width $b_{Sp}$ of the gap S is usually between 2 mm and 20 mm, preferably between 5 mm and 15 mm, for example about 10 mm.

FIG. 2 shows by hatching that the handle assembly 5 comprises two symmetrically identical handle halves each comprising a center section 6*a* or 6*b* and two ends 7*a* and 7*b*, with the ends 7*a*, 7*b* being longitudinally spaced and the sections 6*a*, 6*b* bridging the respective ends 7*a*, 7*b*. Together the sections 6*a* and 6*b* form a handle loop 8.

The handle assembly 5 is preferably attached at the handle ends 7*a*, 7*b* with adhesive 9 (see FIG. 3) to the outside of the respective folded side panel 2*a*, whereas the middle sections 6*a*, 6*b* forming the loop 8 are unattached, so that a user can grip behind the handle loop 8 formed by the two middle sections 6*a* 6*b* if his/her hand is inserted between the respective folded side panel 2*a* and the film handle sections 6*a*, 6*b*.

The two film handle sections 6*a*, 6*b* thus form a single handle loop 8 for the user, the gap S advantageously being dimensioned such that a user can easily grip behind the two film handle sections 6*a*, 6*b* at the handle loop 8 during handling, but the folded side panel 2*a* can also easily be folded at the crease 4 without the handle assembly 5 being in the way and interfering. In addition, a substantial spacing a of at least 15 mm from the side edges 3 also remains, so that folds and/or longitudinal welds 10 can also be formed there without problems during the manufacture of the side-gusset bag.

The handle assembly 5 is usually mounted on the bag film section forming the folded side panel 2*a* before the folded side panel 2*a* is shaped into a bag body either by folding of the bag film or by joining of several pieces of the bag film. Independently of whether the folded side panels 2*a*, 2*b* are supplied as separate film strips or formed from a material web, the required manufacturing process is not substantially impaired by the handle assembly 5 according to the invention, because both the crease 4 and the side edges 3 remain clear. Since the film handle itself does not need to be folded, there is also no substantial spreading effect at the respective first folded side panel 2*a*.

As can be seen in FIG. 2, the two film handle sections 6*a*, 6*b* are usually arranged with mirror symmetry at the crease 4, the gap S running straight over its entire length and having the same width $b_{Sp}$.

To ensure secure attachment of the film handle sections 6*a*, 6*b* to the respective folded side panel 2*a*, the handle assembly 5 can have be widened in the transverse direction q at the handle ends 7*a*, 7*b* with respect to the handle loop 8, so that the two film handle sections 6*a*, 6*b* then have a C-shape starting from the gap S in the direction of the respective adjacent side edge 3.

Figure 3:
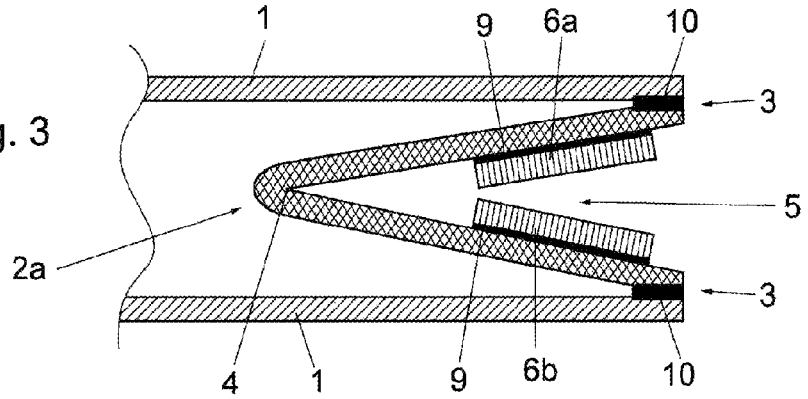
FIG. 3 is a section through the flattened side-gusset bag in the region of the folded side panel shown in FIG. 2 along line of FIG. 2.

FIG. 3 shows a section through the folded side panel 2*a* provided with the handle assembly 5 in a mostly flattened state, the section passing through the handle ends 7, so that the adhesive 9 is also visible there. According to FIG. 3, the two face panels 1 are connected to the folded side panel 2*a* only via the longitudinal welds 10. Such a connection results if the face panels 1 and the folded side panels 2*a*, 2*b* are supplied as separate pieces of a bag film or if the side edges 3 are subsequently edged by folding and welding during manufacture of the folded side panel, that is, if outer edges on the side edges 3 are trimmed away in order to improve the appearance.

According to the embodiment of FIGS. 1 to 3, the two film handle sections 6*a*, 6*b* are interconnected exclusively via the underlying folded side panel 2*a*.

Figure 4:
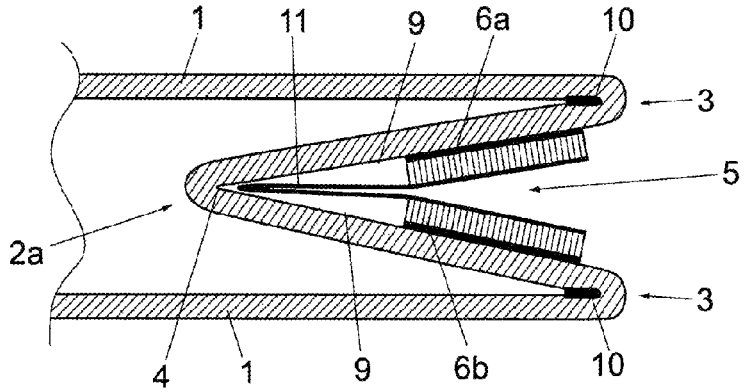
FIG. 4 shows an alternative design of the side-gusset bag in a view like FIG. 3.

FIG. 4 shows an alternative embodiment in which the two film handle sections 6*a*, 6*b* are connected by a thin application film 11. The application film facilitates handling of the handle assembly 5 during manufacture, it then being possible to manipulate the handle assembly 5 like a conventional, continuous one-piece handle. The application film 11 is so thin, however, that it does not bring about any substantial spreading effect.

The thickness ratio of the film handle to the application film 11 is usually at least 3:1. While the film handle usually has a thickness between 150 μm and 400 μm, preferably between 200 μm and 300 μm, the application film can be comparatively thin, for example with a thickness of less than 100 μm, particularly less than 50 μm.

During handling, the carrying forces are substantially absorbed by the two film handle sections 6*a*, 6*b*, the gap S between the two film handle sections 6*a*, 6*b* still being present but being covered toward the outside by the application film 11.

In principle, the application film 11 can also be between the film handle sections 6*a*, 6*b* and the corresponding folded side panel 2*a*, in which case the handle assembly 5 is then attached via the application film 7. If an additional application film 11 is provided, it bridges over the gap S but preferably also has the same shape as the two film handle sections 6*a*, 6*b*, which can result in the appearance of a single handle for the observer.

Figure 5:
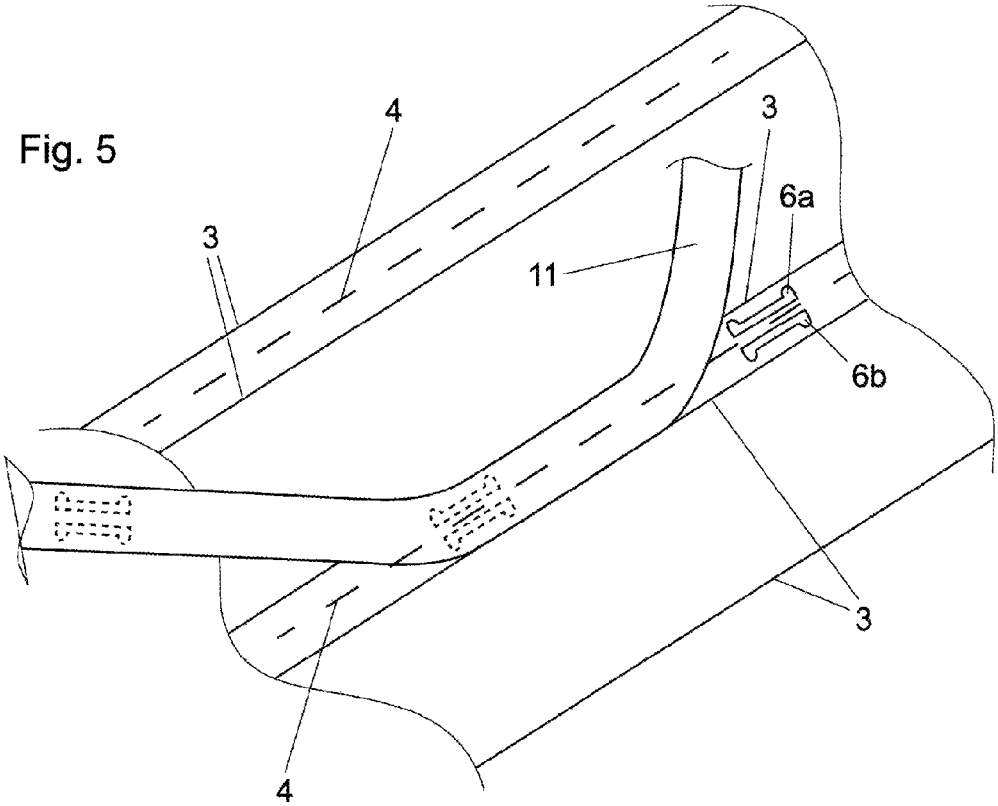
FIG. 5 shows a possible method step for mounting a handle assembly on a film web.

As already explained above, the handle assembly is usually mounted before the side-gusset bag is put together from various pieces or formed by folding. The two film handle sections 6*a*, 6*b* of a handle assembly 5 can be fed either completely independently from each other or connected to an application film. In this context, FIG. 5 shows a variant of the manufacturing method in which the film handle sections 6*a*, 6*b* for several successive side-gusset bags are arranged on an application film 11' that is then removed again after the mounting of the film handle sections 6*a*, 6*b* onto a film web. FIG. 5 shows a material web from which the face panels 1 and the folded side panels 2*a*, 2*b* are then formed subsequently by folding. The side edges and center lines 4 that are not yet present in the material web, are indicated for purposes of orientation.

I claim:

1. A side-gusset bag comprising:

front and back face panels each having longitudinally extending side edges;

two folded side panels each joined to the face panels at the side edges and each having a center longitudinally extending crease between the respective side edges and subdividing the respective side panel into a pair of side folds; and a handle assembly extending transversely over less than 80% of a transverse width of one of the side panels, having outer edges spaced at least 5 mm from the respective side edges, and consisting of a pair of substantially identical handle halves each formed by two longitudinally spaced ends fixed to a respective side fold on an outer face of the respective side fold of the bag to a respective side of the crease thereof and a middle section extending flat and without folds on the respective side panel between the respective ends and formed unitarily therewith of plastic film, the middle sections being transversely spaced by a longitudinally extending gap at least 2 mm wide and aligned with the respective crease, the handle halves being hidden in the one side panel in a flattened condition of the bag.

2. The side-gusset bag defined in claim 1, wherein the outer edges of the handle assembly are spaced at least 15 mm from the two respective side edges.

3. The side-gusset bag defined in claim 1, wherein the bag is formed as a prefabricated flattened package that is sealed at one longitudinal end and unsealed at the opposite longitudinal end for subsequent filling.

4. The side-gusset bag defined in claim 1, wherein the handle halves are with mirror symmetrical to each other at the crease.

5. The side-gusset bag defined in claim 1, wherein the gap is straight over its entire length and has a uniform width that is at least 5 mm.

6. The side-gusset bag defined in claim 1, wherein each of the ends of the handle halves is transversely wider than the respective middle section and projects therefrom away from the respective crease.

7. The side-gusset bag defined in claim 1, wherein the two handle halves are connected to each other exclusively via the one folded side panel.

8. The side-gusset bag defined in claim 1, further comprising:

an application film extending between the halves across the gap and having a width equal to at most one-third of a width of the film of the handle halves.

9. The side-gusset bag defined in claim 1, further comprising:

adhesive fixing the ends of the handle halves to the one side panel.

10. The side-gusset bag defined in claim 1, wherein the film forming the handle has a thickness between 150 μm and 400 μm.

11. The side-gusset bag defined in claim 1, wherein the face panels and the folded side panels are each formed from a multilayered plastic film that can be welded on the inner side of the bag.

12. The side-gusset bag defined in claim 1, wherein the face panels or the folded side panels have a layer made of a plastic woven fabric.

13. The side-gusset bag defined in claim 1, wherein the folded side panels are longitudinally shorter than the face panels.

14. The side-gusset bag defined in claim 1, further comprising:

longitudinal welds at the side edges.

* * * * *